US010317163B2

(12) United States Patent
Poindexter

(10) Patent No.: US 10,317,163 B2
(45) Date of Patent: Jun. 11, 2019

(54) ADJUSTABLE STABILIZER ASSEMBLY FOR RIFLE

(71) Applicant: Paul Poindexter, Oklahoma City, OK (US)

(72) Inventor: Paul Poindexter, Oklahoma City, OK (US)

( * ) Notice: Subject to any disclaimer, the term of this patent is extended or adjusted under 35 U.S.C. 154(b) by 0 days.

(21) Appl. No.: 15/732,897

(22) Filed: Jan. 11, 2018

(65) Prior Publication Data

US 2018/0202745 A1 Jul. 19, 2018

Related U.S. Application Data

(60) Provisional application No. 62/499,046, filed on Jan. 13, 2017.

(51) Int. Cl.

| | |
|---|---|
| ***F41A 23/02*** | (2006.01) |
| ***F41C 23/16*** | (2006.01) |
| ***F41G 1/00*** | (2006.01) |
| ***F41G 11/00*** | (2006.01) |
| *F41A 23/12* | (2006.01) |
| *F41A 23/08* | (2006.01) |

(52) U.S. Cl.

CPC ..... *F41A 23/02* (2013.01); *F41G 11/003* (2013.01); *F41A 23/08* (2013.01); *F41A 23/12* (2013.01)

(58) Field of Classification Search

CPC ..... F41A 23/12; F41A 23/02; F41A 23/08; F41A 23/04; F41A 23/06; F41A 23/10; F41A 23/14; F41A 35/00; F41G 11/003; F41C 27/00; F41C 27/04; F41C 27/06

See application file for complete search history.

(56) References Cited

U.S. PATENT DOCUMENTS

| | | | | | |
|---|---|---|---|---|---|
| 4,296,566 | A * | 10/1981 | Campos | F41C 23/14 | 42/71.01 |
| 4,409,751 | A | 10/1983 | Goda | | |
| 4,651,432 | A * | 3/1987 | Bornancini | F41C 3/14 | 42/133 |
| 4,733,489 | A * | 3/1988 | Kurak | F41C 27/06 | 42/105 |
| 4,971,208 | A | 11/1990 | Reinfried | | |
| 5,074,188 | A * | 12/1991 | Harris | F41A 23/08 | 42/94 |
| 5,875,580 | A | 3/1999 | Hill | | |
| 5,979,099 | A | 11/1999 | Kervin | | |
| 6,023,875 | A * | 2/2000 | Fell | F41C 23/22 | 362/114 |
| 7,185,862 | B1 * | 3/2007 | Yang | F16M 11/041 | 248/187.1 |
| 7,243,454 | B1 * | 7/2007 | Cahill | F41C 23/12 | 42/72 |
| 7,559,169 | B2 * | 7/2009 | Hung | F41G 1/32 | 396/426 |
| 7,770,320 | B1 | 8/2010 | Bartak | | |
| 7,856,748 | B1 | 12/2010 | Mertz | | |

(Continued)

*Primary Examiner* — Derrick R Morgan

(57) ABSTRACT

A rifle stabilizer assembly attaching to a front stock of a rifle provides an assortment of stabilizing elements to enhance the shooting potential of a rifle, the assembly providing a stabilizer bar attached to the underside of a front rifle stock, a barrier block attachment, a bipod adapter attachment and a tripod adapter attachment, each attachment selectively chosen by a shooter as appropriate for a selected shot while in competition, hunting or combat.

12 Claims, 7 Drawing Sheets

(56) References Cited

U.S. PATENT DOCUMENTS 8,549,786 B1 10/2013 Griffith
8,667,727 B2 * 3/2014 Engelhardt ..... F41G 11/003 42/124
8,794,575 B2 * 8/2014 Vogt ..... F16M 11/041 248/177.1
9,038,305 B2 * 5/2015 Volfson ..... F16M 13/02 42/90
9,291,430 B2 * 3/2016 Clark ..... F41G 11/00
9,488,446 B2 * 11/2016 Zimmer ..... F41G 11/003
9,568,282 B1 * 2/2017 Schorman ..... F16M 13/02
9,631,897 B1 * 4/2017 Irwin ..... F41G 11/003
2006/0196099 A1 * 9/2006 Matthews ..... F41G 11/003 42/146
2006/0207157 A1 * 9/2006 Keng ..... F41G 1/32 42/132
2007/0074437 A1 * 4/2007 Compton ..... F41A 35/06 42/12
2007/0113461 A1 * 5/2007 Wang ..... F41G 11/003 42/146
2007/0113462 A1 * 5/2007 Ho ..... F41G 11/003 42/146
2008/0307689 A1 12/2008 Dotson
2009/0044439 A1 * 2/2009 Phillips ..... F41C 23/14 42/72
2009/0056192 A1 * 3/2009 Oz ..... F41A 23/08 42/94
2009/0133309 A1 * 5/2009 Cahill ..... F41C 23/12 42/72
2009/0249674 A1 10/2009 Boord
2010/0005697 A1 * 1/2010 Fluhr ..... F41G 1/02 42/111
2010/0192444 A1 * 8/2010 Cabahug ..... F41G 11/003 42/71.02
2011/0099873 A1 * 5/2011 Bentley ..... F41C 23/16 42/71.01
2011/0173865 A1 * 7/2011 Compton ..... F41G 11/003 42/84
2012/0055062 A1 * 3/2012 Mironichev ..... F41C 23/02 42/85
2012/0057360 A1 * 3/2012 Swan ..... A42B 3/04 362/389
2012/0131837 A1 * 5/2012 Cabahug ..... F41C 23/22 42/84
2012/0159831 A1 * 6/2012 LaFrance ..... F41G 11/001 42/90
2012/0167437 A1 * 7/2012 Holmberg ..... A01M 31/002 42/90
2012/0227304 A1 * 9/2012 Engelhardt ..... F41C 27/00 42/90
2013/0312307 A1 * 11/2013 Rorick ..... F41C 27/00 42/90
2013/0312309 A1 * 11/2013 Rorick ..... F41G 11/003 42/114
2014/0190063 A1 * 7/2014 Lau ..... F41G 11/003 42/146
2014/0196349 A1 * 7/2014 Rogers ..... F41G 11/003 42/90
2014/0259854 A1 * 9/2014 Williams ..... F41G 11/003 42/124
2014/0360079 A1 * 12/2014 Iannello ..... F41G 11/003 42/90
2015/0075054 A1 * 3/2015 Barger ..... F41G 11/003 42/90
2016/0003460 A1 * 1/2016 Li ..... F21V 21/08 362/191
2016/0054089 A1 2/2016 Sherman
2016/0097611 A1 * 4/2016 Sharron ..... F41C 27/00 42/90
2016/0102947 A1 * 4/2016 Visinski ..... F41C 27/00 42/90
2016/0153744 A1 * 6/2016 Teetzel ..... F41C 27/06 42/105
2016/0273863 A1 * 9/2016 Hayes ..... F41A 23/08
2016/0273875 A1 * 9/2016 Cottle ..... F41C 23/14
2017/0067720 A1 * 3/2017 Visinski ..... F41G 11/003
2017/0138693 A1 * 5/2017 Roberts ..... F41G 11/001
2017/0167817 A1 * 6/2017 Hayes ..... F41A 23/10
2017/0254615 A1 * 9/2017 Kennair, Jr. ..... F41C 27/00
2017/0299337 A1 * 10/2017 Ding ..... F41G 11/004
2018/0195838 A1 * 7/2018 Storch ..... F41A 3/66

* cited by examiner

ADJUSTABLE STABILIZER ASSEMBLY FOR RIFLE

CROSS REFERENCE TO RELATED APPLICATIONS

Applicant claims the benefit of Provisional Patent No. 62/499,046, filed on Jan. 13, 2017 by the same inventor.

I. BACKGROUND OF THE INVENTION

1. Field of Invention

A rifle stabilizer assembly attaching to a front stock of a rifle provides an assortment of stabilizing elements to enhance the shooting potential of a rifle, the assembly providing a stabilizer bar attached to the underside of a front rifle stock, a barrier block attachment, a bipod adapter attachment and a tripod adapter attachment, each attachment selectively chosen by a shooter as appropriate for a selected shot while in competition, hunting or combat.

2. Description of Prior Art

A preliminary review of prior art patents was conducted by the applicant which reveal prior art patents in a similar field or having similar use. However, the prior art inventions do not disclose the same or similar elements as the present rifle stabilizer assembly, nor do they present the material components in a manner contemplated or anticipated in the prior art.

It is known in the art that certain fixed mounting systems exist, providing for mounting systems to a rifle that compose rails. These include Picatiny and Weaver systems, which employ recoil grooves with a similar profile mounted to a front stock of a rifle for attachment of a bipod for long range shooters. They provide a rail with specific grooves of width and depth and mount a bipod, with the bipod including grooved channels which accept the rail and provide for recoil during the act of shooting. The is no fixed connection between the rail and the bipod mounting bracket. Another system known to shooters is the "Arca Rail" system and Arca rail clamp, together called and Arca-Swiss interface, for mounting cameras to tripods, which has been adapted for rifle mounting. Other known mounting systems include Keymod, M-Lok, Hkey, AI Keyslot and UTT/Anschutz rails.

With regard to prior art patents, a first patent, U.S. Pat. No. 7,856,748 to Mertz, provides a bipod support and mount for a firearm, providing a front leg support with two extending legs, with the leg support including two bore within which the two bipod legs attach by a respective ball joint. A ball is mounted to a rifle stock which mounts a ball mount receiver to receive the ball. In certain embodiments, a leg keeper or a band strap are also included toward the trigger along the front stock to squeeze the legs under the front stock when not in use. A similar retractable bipod system is demonstrated in U.S. Pat. No. 7,770,320 to Bartak, which provides a stock mounting body member attaching to an internally threaded opening, provided in most rifles for attaching a front end of a swivel mounted strap. The stock mounting body member includes a pair of parallel bores which provide for containment of a pair of bipod legs, which are pulled out of the bores, each leg defining a ball that installs within sockets formed at each bore opening. A third prior art patent application, U.S. Patent Application No. 2008/0307689 to Dotson, provides a replacement front stock for a rifle which includes a forearm chamber within a stock forearm, at least one frame member secured within the forearm chamber and a leg slidingly attached to the frame member at a pin, the leg capable of being in a fully stored position being generally within the forearm chamber, or being fully deployed in a position in which the leg is allowed to slide along the frame member out of a forearm chamber, pivot about a pin into a position which is generally perpendicular to the frame member and barrel to interact with a surface to support and steady the rifle. There is shown two parallel formed slots in each side.

None of the prior art indicates a bar rail defining a linear dovetail mechanism, installation of one or more barrier blocks within the dovetail mechanism selectively locking at least one locking pin elevated within one of a plurality of evenly spaced upper lock pin indents, allowing for independent selective placement of each barrier block while allowing a degree of rotational manipulation of each barrier block while locked into position within the bar rail, installation of a bipod mounting member within the same bar rail, with the bipod mounting member upwardly extending a dovetail extension with at least one locking pin selectively engaging at least one of the plurality of evenly spaced upper locking pin indents and extending a lower bipod mounting base, or a tripod mounting member upwardly extending a dovetail extension with at least one locking pin selectively engaging at least one of the plurality of evenly spaced upper locking pin indents and extending a lower tripod mounting base, all of them providing for the engagement and release of the respective locking pin by a manual pin locking means, for installation and removal of each barrier block, bipod mounting member or tripod mounting member.

II. SUMMARY OF THE INVENTION

Accurate long range rifle shooting requires stability of both the front and rear of the rifle when aiming and firing. While some choose to fire without any support, others who desire more accuracy, especially at long range, employ supports at the rear stock, the front stock or sometimes, both the front and rear stocks contemporaneously. Most common is use of a bipod for prone shots, tripods for standing shots, front stabilizing support aided by a barrier, sandbags resting on flat surfaces underneath the rifle, or simply resting the arms of the shooter on a surface.

The current barrier stabilizer assembly provides a slide bar mounting to the underside of the front stock of a rifle, the slide bar defining a lower linear dovetail slot or expansion, at least two adjustable width sliding barrier blocks having a variable degree of radial rotation, a bipod mounting member adapted to secure a bipod below the front of the rifle or a tripod mounting member adapted to secure the rifle upon a tripod stand. An upper surface of the slide bar adapts to, is embedded within or incorporated into the factory front stock of a rifle and is attached by at least two screws.

Each barrier block is respectably adjustable at a selected location along the length of the slide bar and with a selected distance between each barrier block. The bipod mounting member is also adjustable along the length of the slide bar and is adapted to provide attachment for a lower bipod. The tripod mounting member is also adjustable along the length of the slide bar and is adapted to provide attachment for a lower tripod.

Each barrier block, bipod mounting member and tripod mounting member extend an upward dovetail extension adapted to slide within the linear dovetail slot of the slide bar, with at least one upwardly extending lock pin engaged and released by a manual pin locking means, with each lock pin engaging at least one selected upper lock pin detents among a plurality of evenly spaced and aligned upper lock pin detents located in a lower surface of the slid bar within the lower linear dovetail slot, which secure each barrier block, bipod mounting member or tripod mounting member at a selected location along the slide bar below the front rifle stock. While the shooter would select the at least two barrier blocks, the bipod mounting member or the tripod mounting member for use, the slide bar would accommodate the installation of all three choices.

It is contemplated within the scope of the barrier stabilizer assembly that the slide bar extends a lower dovetail extension, with each barrier block, bipod mounting member and tripod mounting member extending an upper dovetail slot selectively engaging the dovetail expansion of the slide bar, reversing the dovetail expansion and dovetail slot of the previously disclosed embodiment.

III. DESCRIPTION OF THE DRAWINGS

The following drawings are submitted with this utility patent application.

FIG. 6 is a side view showing engagement of the barrier blocks upon a rectangular wall or rail.

IV. DESCRIPTION OF THE PREFERRED EMBODIMENT

Figure 1:
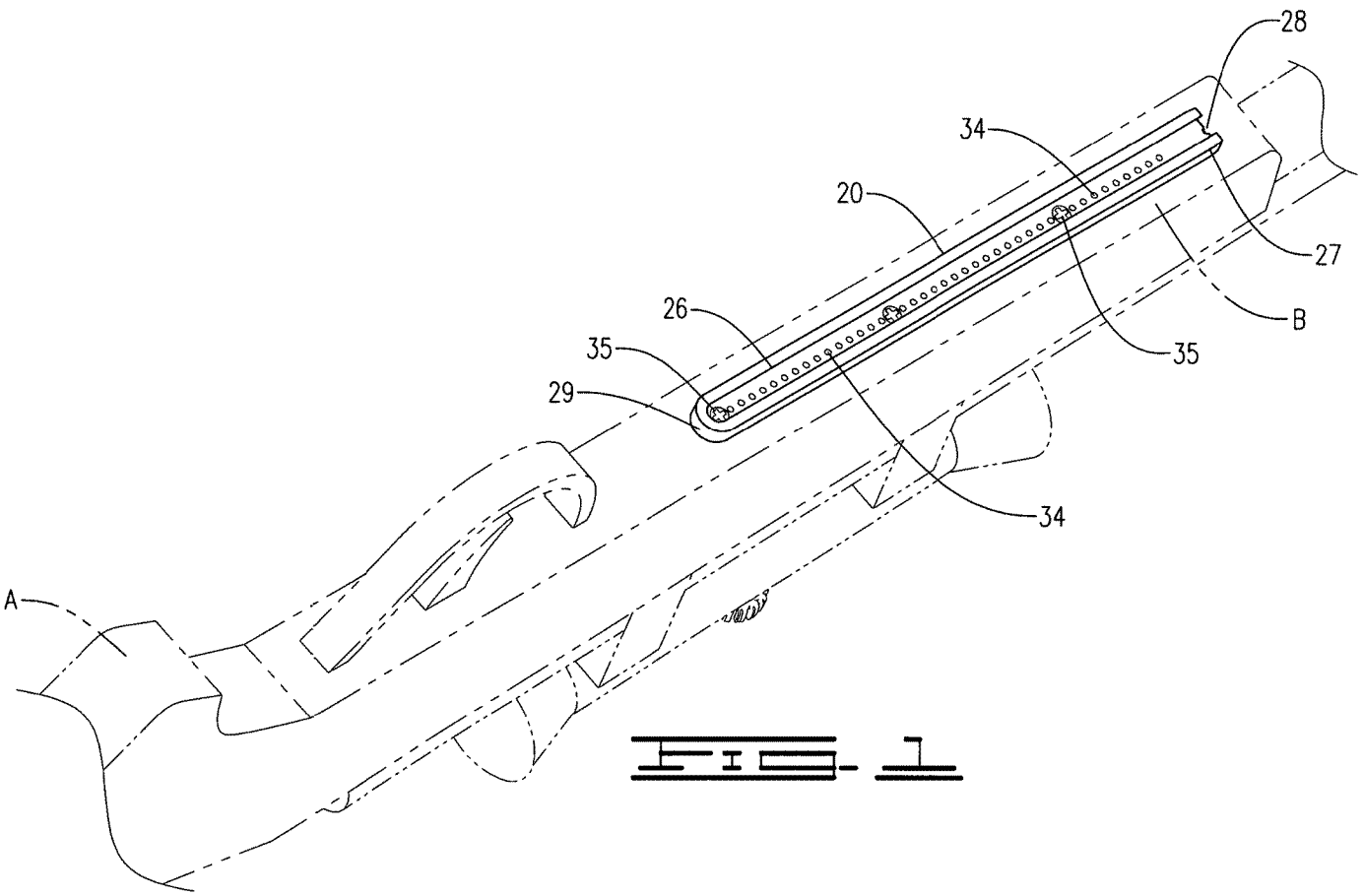
FIG. 1 is a lower view of a rifle and front stock, shown in phantom, with an installed linear bar rail attached to the front stock.
Figure 2:
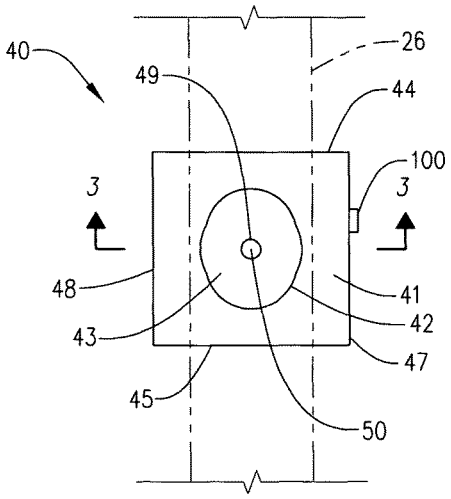
FIG. 2 is a top view of a barrier block with phantom lines indicating installation upon the linear bar rail.

An adjustable rifle stabilizer assembly 10 for attachment to a front rifle stock B of a rifle A or other long gun, as shown in FIGS. 1-11, provides for a stabilization of the attached rifle upon a barrier, bipod or tripod stand or other solid structure during shooting. For purposes of this disclosure, a rifle A or other long gun will be collectively referenced as a rifle A, although contemplated for use with a shotgun, black power long gun or other non-handgun firearm. In addition, since the application of the rifle stabilizer assembly 10 is provided for rifles of various sizes, gauges, calibers and dimensions of front stocks, no claim is made to dimension, length or width, thickness or depth within this disclosure other than to generalize them adapted to, imbedded within or incorporated into the various rifles. The rifle stabilizer assembly includes a linear bar rail 20 affixed to a lower surface of a front rifle stock B, FIG. 1, one or two barrier blocks 40, FIGS. 2-6, a bipod mounting member 60, FIGS. 7-8, or a tripod mounting member 80, FIGS. 9-11.

Figure 3:
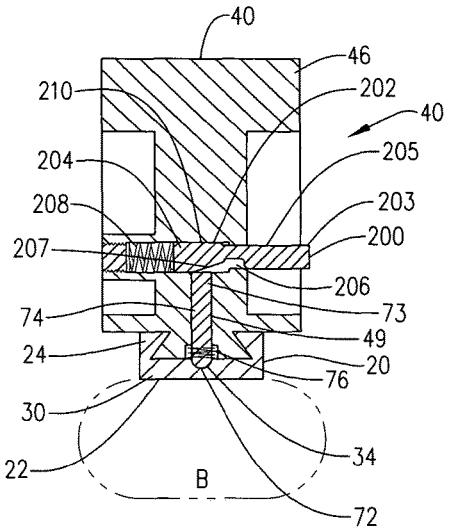
FIG. 3 is a sectional view of the barrier block along lines 3/3 of FIG. 2.
Figure 4:
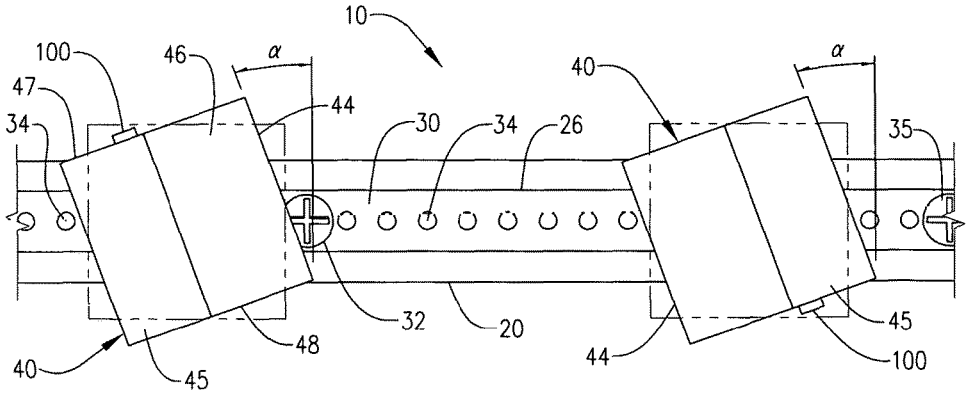
FIG. 4 is a lower view of two barrier blocks attached within the linear bar rail demonstrating the rotational capacity of the barrier blocks.
Figure 8:
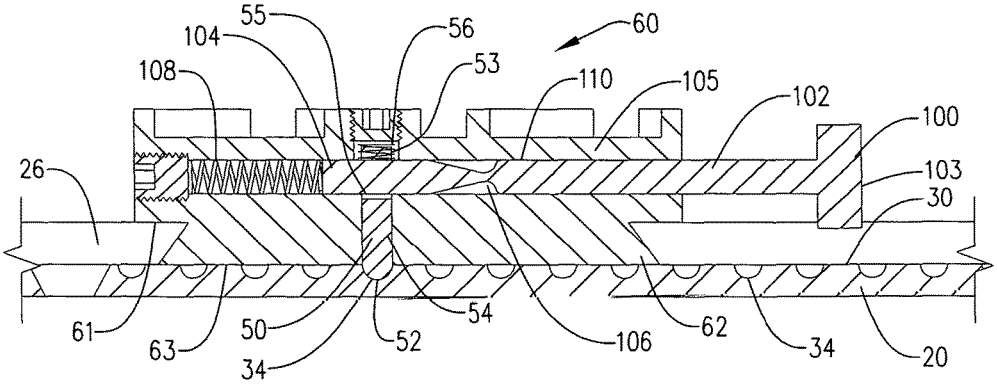
FIG. 8 is a sectional view of the bipod mounting member along section lines 8/8 of FIG. 7.
Figure 9:
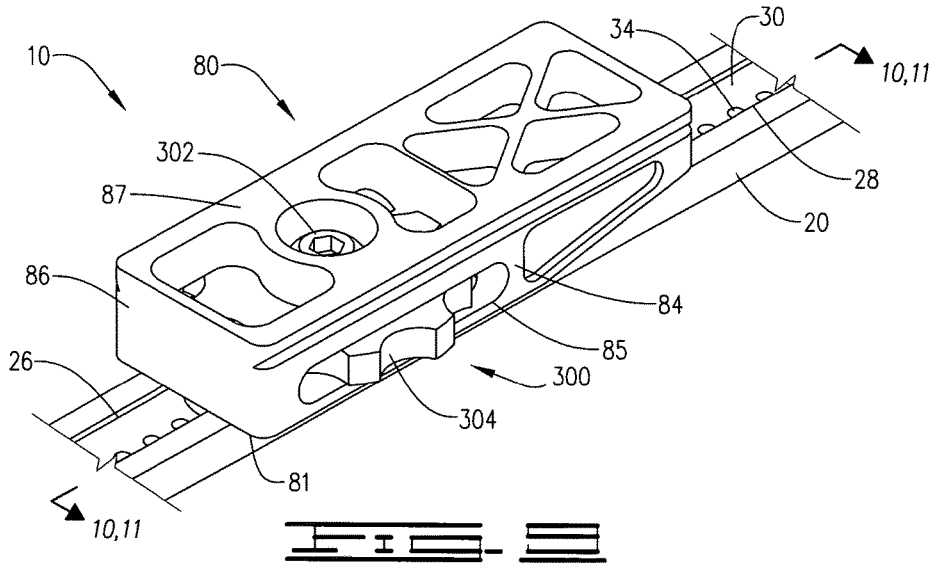
FIG. 9 is a lower view of the tripod mounting member attached within the linear bar rail.
Figure 10:
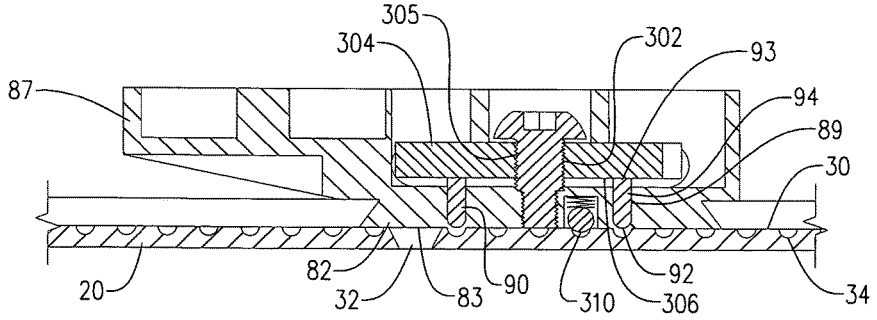
FIG. 10 is a sectional view of the tripod member along section lines 10/10 of FIG. 9, indicating an unlocked position.
Figure 11:
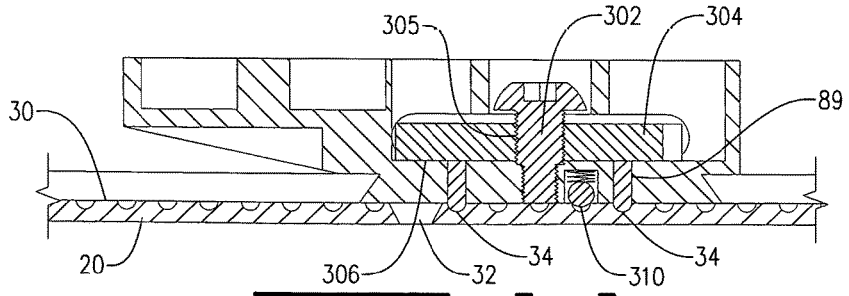
FIG. 11 is a sectional view of the tripod mounting member along section lines 11/11 of FIG. 9 indicating a locked position.

The linear bar rail 20, FIGS. 1-11, further comprises an upper surface 22 adapting in contour and dimension to the lower surface of the front rifle stock B, FIG. 1, a lower portion 24 defining a linear dovetail slot 26 presenting a first end 27 forming a slot opening 28, FIGS. 1 and 4, and a second closed end 29, terminating within but not through the bar rail 20, the linear dovetail slot 26 further defining an upper slot surface 30 defining a plurality of evenly spaced pin detents 34 and at least two recessed mounting bores 32, FIGS. 1, 10 and 11, through which respective installation screws 35 are securely installed to secure the linear bar rail 20 to the front rifle stock B. Each pin detent 34 is be defined as a half spherical indentation, a hole, a partial channel or other adaptive indentation which extends above the upper slot surface 30 of the linear dovetail slot 26 in a uniform manner, allowing for the insertion and retention of upward urged lock pins 50, 70, 90, later defined herein. Although shown as an elongated rectangle, the shape of the linear bar rail 20 is irrelevant, provided it defines the purpose stated herein. It is best that the linear bar rail 20 is made of a light-weight metal or heavy composite material and that the linear dovetail slot be either cast or milled, depending upon the chosen material composition. The installation screws 35 secured within the recessed mounting bores 34 must extend no further than the upper slot surface 30 and avoid interference with the profile of the linear dovetail slot 26 once installed.

Each barrier block 40, shown in FIGS. 2-6, further comprises a flat upper portion 41 extending an oval dovetail expansion 42 defining a flat upper surface 43, a first barrier surface 44 depending from the flat upper portion 41 perpendicular to the flat upper portion 41, a second barrier surface 45 depending from the flat upper portion 41 at a reduced angle progressing downward, a lower portion 46 between the first and second barrier surfaces 44, 45, a first side plate 47, and a second side plate 48. The first and second barrier surfaces 44, 45, may include a friction enhanced coating or a textured surface, not shown. The oval dovetail extension 42 is inserted within the slot opening 28 and slidable engages the linear dovetail slot 26 of the linear bar rail 20, FIG. 3.

At least one upward urged lock pin 50 is centrally located within the upper surface 43 of the oval dovetail expansion 42 which may be intentionally lowered below the upper surface 43 by a lock pin release means 100, 200, 300, FIG. 3, which is situated within the first side plate 47, the second side plate 48 or both. The placement of the lock pin release means 100, 200, 300, is designed to avoid the first and second barrier surfaces 44, 45, to prevent interference and access to these surfaces which are engaged with the barrier when in use and also to prevent accidental disengagement of each barrier block 40 from the linear bar rail 20 during use. Each at least one lock pin 50 defines a rounded cylindrical head 52 which extends above the upper surface 43 of the oval dovetail expansion 42 into a locked position, placing the cylindrical head 52 within a selected pin detent 34 as determined by the user to lock the respective barrier block 40 into a position along the linear bar rail 20 suited for the chosen rifle shot. In addition to the lock pin 50 as disclosed within the drawings and referenced above, the lock pin may be embodied as a ball, a cylinder, a shaped taper, an irregular shape or any shape conforming to the pin detents 34 within the linear bar rail 20. While at rest, the lock pin 50 is elevated into a locked position and prevented from downward movement until such time as the lock pin release means 100, 200, 300, is activated, allowing for the rounded head 52 of the lock pin 50 to be lowered below the upper surface 43 and moved along the linear bar rail 20 or removed from the slot opening 28. Various embodiments of the lock pin release means 100, 200, 300, are further disclosed below. While locked within the linear bar rail 20, the oval dovetail expansion 42 allows an overall bidirectional axial pivot of each barrier block 20 as indicated in FIG. 4, while preventing linear movement of the barrier block 20 in a forward or reverse movement.

Figure 5:
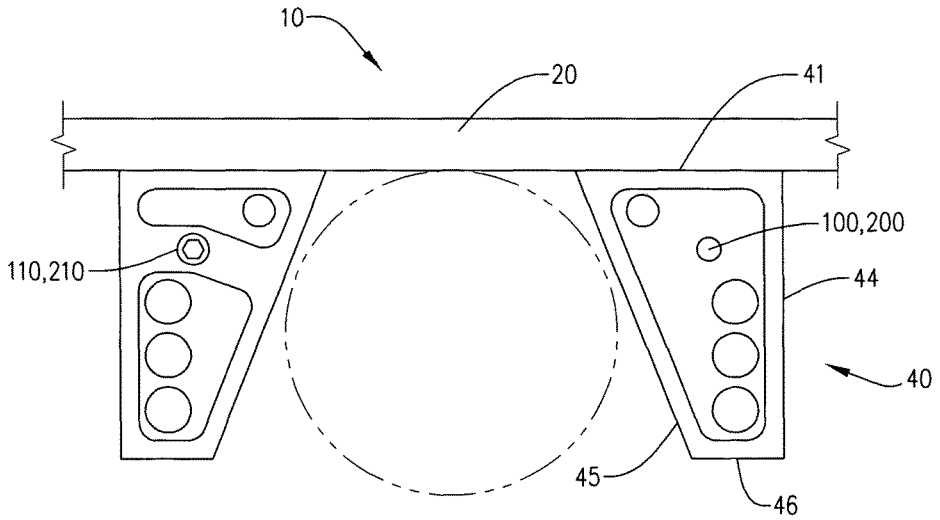
FIG. 5 is a side view showing engagement of the barrier blocks upon a cylindrical rail.
Figure 5:
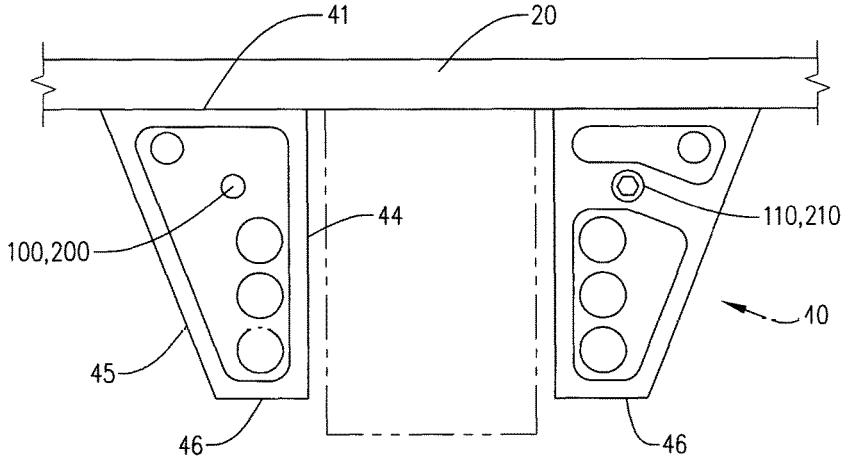

Examples of the barrier upon which the barrier blocks 20 may be include pipes, fences, a vertical wall or a ledge, FIGS. 5-6. One can observe that each barrier block 20 offers two different presenting surfaces, either the second barrier surfaces engaging the pipe, FIG. 5, or the two flat front barrier surfaces engaging the vertical wall, FIG. 6. It is also contemplated that a single barrier block 20 may be use to prop the rifle above an object with the single barrier block providing a pull-back force against an object, or while being pulled towards the rear to steady a shot. The significance of the rotational capacity of each barrier block 20 provides for the axial adjustment of the barrier blocks 20 allowing the shooter to sight and aim the rifle A to a target while using a stationary and likely immovable barrier for support. This rotational capacity of each barrier block a may provide for an adjustment between 0 and 45 degrees, FIG. 4.

Figure 7:
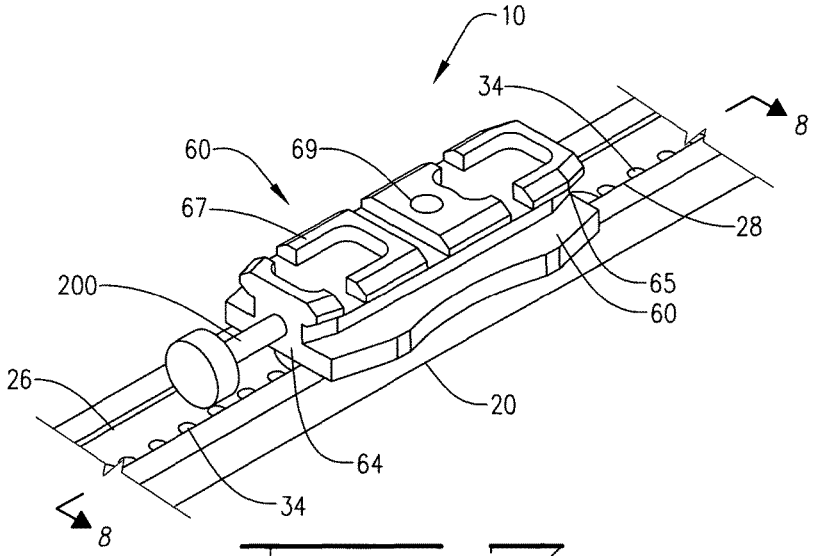
FIG. 7 is a lower view of the bipod mounting member attached within the linear bar rail.

The bipod mounting member 60, FIGS. 7-8, further defines a flat upper portion 61 upwardly extending an upper dovetail expansion 62 defining a flat upper surface 63, a front margin 64, a rear margin 65 and a lower portion 66 providing a bipod mounting base 67 which provides a location for the mounting of a bipod, the bipod not made part of the present invention. The upper dovetail expansion 62 of the bipod mounting member is inserted within and slidable engage the slot opening 28 and the linear dovetail slot 26 of the linear bar rail 20, FIG. 8. Unlike the oval dovetail expansion 42 of the barrier block, the upper dovetail expansion 62 of the bipod mounting member 60 provides no rotation once inserted and contained within the dovetail slot 26 of the linear bar rail 20, but it is contemplated within the scope of the invention that it could, although not shown in the drawing figures.

At least one upward urged lock pin 70 is centrally located within the upper surface 63 of the upper dovetail expansion 62 which may be lowered below the upper surface 63 by a lock pin release means 100, 200, 300, which is situated within the front margin 64, the rear margin 65 or both. Placement of the lock pin release means 100, 200, 300, is essentially located to prevent interference with the mounting and dismounting of the bipod from the bipod mounting base, which is generally accomplished through a side sliding interaction between the bipod and the bipod mounting member 60. Each at least one lock pin 70 defines a rounded cylindrical head 72 which extends above the upper surface 63 of the upper dovetail expansion 62 into a locked position, placing the cylindrical head 72 within a selected pin detent 34 as determined by the user to lock the bipod mounting member 60 into a position along the linear bar rail 20 suited for the chosen rifle shot. In addition to the lock pin 70 as disclosed within the drawings and referenced above, the lock pin may be embodied as a ball, a cylinder, a shaped taper, an irregular shape or any shape conforming to the pin detents 34 within the linear bar rail 20. While at rest, the lock pin 70 is elevated into a locked position and prevented from downward movement until such time as the lock pin release means 100, 200, 300, is activated, allowing for the rounded head 72 of the lock pin 70 to be lowered below the upper surface 63 and moved within the linear bar rail 20 or removed from the slot opening 28. Various embodiments of the lock pin release means 100, 200, 300, are further disclosed below. The significance of the lack of rotational capacity of the bipod mounting member 60 as opposed to the rotation of the barrier blocks 20 is that the normal use of a bipod occurs when supporting the rifle on the ground or upon a flat surface, the bipod providing the elevation and support for the shot instead of the stationary barrier.

The attaching bipod is an accessory which is intended to be purchased separately and installed upon the bipod mounting member 60. As mentioned earlier in the specification, bipods provided in prior art and in the marketplace, these include Picatiny and Weaver systems, which employ recoil grooves with a similar profile mounted to a front stock of a rifle for attachment of a bipod for long range shooters. They provide a rail with specific grooves of width and depth and mount a bipod, FIG. 7, with the bipod including grooved channels which accept the rail and provide for recoil during the act of shooting. The is often no immovable fixed connection between the rail and the bipod mounting bracket which may allow a certain degree of recoil absorption between the bipod and the bipod mounting member, but it is contemplated that a hard fixed means may also be provided, neither connection shown in the drawing figures.

The tripod mounting member 80, FIGS. 9-11, further defines a flat upper portion 81 upwardly extending an upper dovetail expansion 82 defining a flat upper surface 83, two lateral portions 84 and a lower portion 86 providing a tripod attaching base 87 which provides a location for the mounting of a tripod, the tripod also not made part of the present invention. The upper dovetail expansion 82 of the tripod mounting member 80 is inserted within and slidable engage the slot opening 28 of the linear dovetail slot 26 of the linear bar rail 20, FIGS. 10-11. Unlike the oval dovetail expansion of the barrier block 20, the upper dovetail expansion 82 of the tripod mounting member provides no rotation once inserted and contained within the linear dovetail slot 26 of the linear bar rail 20, but it is contemplated within the scope of the invention that it could, although not shown in the drawing figures.

At least one upward directed lock pin 90 is centrally located within the upper surface 83 of the upper dovetail expansion 82 which may be lowered below the upper surface 83 by a lock pin activation/release means 100, 200, 300, which is situated within one or both of the lateral portions 86. Placement of the lock pin release means 100, 200, 300, is essentially located to prevent interference with the mounting and dismounting of the tripod from the tripod mounting base 80, which is generally accomplished through a side sliding interaction between the tripod and the tripod mounting member 80. Each at least one lock pin 90 defines a rounded cylindrical head 92 which extends above the upper surface 83 of the upper dovetail expansion 82 into a locked position, FIG. 11, placing the cylindrical head 92 within a selected pin detent 34 as determined by the user to lock the tripod mounting member 80 into a position along the linear bar rail 20 suited for the chosen rifle shot. In addition to the lock pin 90 as disclosed within the drawings and referenced above, the lock pin may be embodied as a ball, a cylinder, a shaped taper, an irregular shape or any shape conforming to the pin detents 34 within the linear bar rail 20. There may also be a locator pin 310 utilized between two upward directed lock pins 90, with the locator pin 310 not locking within the linear bar rail 20 while the two upward directed lock pins 90 are later locked. While at rest, the lock pin(s) 90 is/are elevated into the locked position and prevented from downward movement until such time as the lock pin release means 100, 200, 300, is activated, allowing for the lock pin(s) 90 to be lowered below the upper surface 83 and moved along the linear bar rail 20 or removed from the slot opening 28 into an unlocked position, FIG. 10. Various embodiments of the lock pin release means 100, 200, 300, are again further disclosed below.

The attaching tripod is an accessory which is intended to be purchased separately and installed upon the tripod mounting member 80. As mentioned earlier in the specification, tripods provided in prior art and in the marketplace, these include the "Arca Rail" system and Arca rail clamp, together called and Arca-Swiss interface, for mounting cameras to tripods, which has been adapted for rifle mounting. Other known mounting systems include Keymod, M-Lok, Hkey, AI Keyslot and UIT/Anschutz rails for attachment of a tripod for long range shooters. They provide a rail with specific grooves of width and depth and mount a tripod, with the tripod including grooved channels which accept the tripod rails. It is contemplated that a hard fixed means may also be provided or one allowing for recoil.

In a first embodiment of the lock pin release means 100, FIG. 8, the upward urged lock pin 50 defines the rounded head 52, a base 53 and a shaft 54 having a central reduced portion 55 compelled upward by a first spring 56 within a vertical pin bore 49. The lock pin release means 100 provides a transverse mounted release pin 102 with a depression end 103 and a base end 104 compelled outward by a second spring 108 within a transverse bore 110, with the depression end 103 extending outward from the first or second side plate 47, 48. The release pin 102 further defines a cylindrical shaft 105, a central reduced bypass portion 106 and a tapered shaft portion 107. The lock pin 50 is in a locked position when the release pin 102 is stationary and at rest, with the central reduced portion 55 of the lock pin 50 immovable up or down due to interference of the cylindrical shaft 105 of the release pin 102 being located within the central reduced portion 55 of the lock pin 50. When the release pin 102 is depressed against the force of the second spring 108, the release pin 102 is move so that its reduced bypass portion 106 is located within the reduced portion 55 of the lock pin 50, allowing for the rounded head 52 of the lock pin 50 to be completely lowered below the upper surface 43 of the dovetail expansion 42, releasing engagement with one of the plurality of pin detents 34 which maintain position of the workpiece (selected from the barrier block 40, bipod mounting member 60 or tripod mounting member 80) within the linear bar rail 20. The tapered shaft portion 107, when positioned under the base 53, provides for partial retraction of the lock pin 50, and full retraction when the base 53 is located above the reduced central portion 55. When the lock pin 50 is released, the workpiece 500 can be removed or moved elsewhere within the linear bar rail 20. This embodiment is most practical for the barrier block 20.

A second embodiment lock pin release means 200, FIG. 3, the upward urged lock pin 70 defines the rounded head 72, a base 73 and a shaft 74 compelled upward by a first spring 76 within a vertical pin bore 69. The lock pin release means 200 provides a transverse mounted release pin 202 with a depression end 203 and a base end 204 compelled outward by a second spring 208 within a transverse bore 210, with the depression end 203 extending outward from a front or rear margin 64, 65. The release pin 202 further defines a cylindrical shaft 205, and a central reduced diameter portion 206. The lock pin 70 is in a locked position when the release pin 202 is stationary and at rest, with the base 73 of the lock pin 70 immovable up or down due to interference contact with the cylindrical shaft 205 of the release pin 202 being located below and in contact with the base 73 of the lock pin 70. However, when the release pin 202 is depressed against the force of the second spring 208, the release pin 202 is move so that its reduced portion is located below the base 73 of the lock pin 70, allowing for the rounded head 72 of the lock pin 70 to be lowered below the upper surface 63 of the dovetail expansion 62, releasing engagement with one of the plurality of detents 34 which maintain position of the workpiece 20, 40, 60, 500 within the linear bar rail 20. When the lock pin 70 is released, the workpiece 500 can be removed or moved elsewhere within the linear bar rail 20. This embodiment is most practical for the bipod mounting member 60.

In yet a third embodiment of the lock pin activation/release means 300, FIGS. 10-11, one or two upward directed lock pins 90 define the rounded head 92, a base 93 and a shaft 94 contained within a respective vertical pin bore 89. This embodiment has no release pin. Instead, an outer threaded shaft 302 within at least one lateral slot 85 between the lateral portions 84 of the workpiece 500, within which is placed a rotating wheel 304 defining a central threaded bore 305 rotatably engaging the shaft 302, allowing upward and downward movement of the wheel 304 upon rotation. The rotating wheel 304 further defines an upper surface 306, which is in contact with the base 93 of the one or two upward directed lock pins 90. When the rotating wheel 304 is elevated by rotation, the one or two lock pins 90 are moved upward under force into the locked position, FIG. 11. When the rotating wheel 304 is lowered by rotation, the one or two lock pins 90 are retracted within the respective vertical pin bore 89 into the unlocked position, FIG. 10. The one or two lock pins 90 engage a respective detent 34 within the linear bar rail 20 when compelled upward. In order to avoid damage to the linear bar rail 20 and detents 34 by accidental misalignment of the lock pins 90 and the detents 34, the spring loaded locator pin 310 may be added along with the lock pins 90 to properly align the lock pins 90 before forcible upward movement to lock the one or two lock pins 90 within the linear bar rail 20. This embodiment is best suited for the tripod mounting member 80. It is contemplated that other lock pin release means beyond those disclosed in the first, second and third embodiments of the lock pin release means 100, 200, 300, may be formed of the elements found in the three disclosed embodiment in various combinations, as well as others than may provide for the functional capabilities to manually raise and lower the lock pins 50, 70, 90, for insertion and movement of the barrier blocks 40, bipod mounting member 60 or tripod mounting member 80, within the linear bar rail 20.

Figure 12:
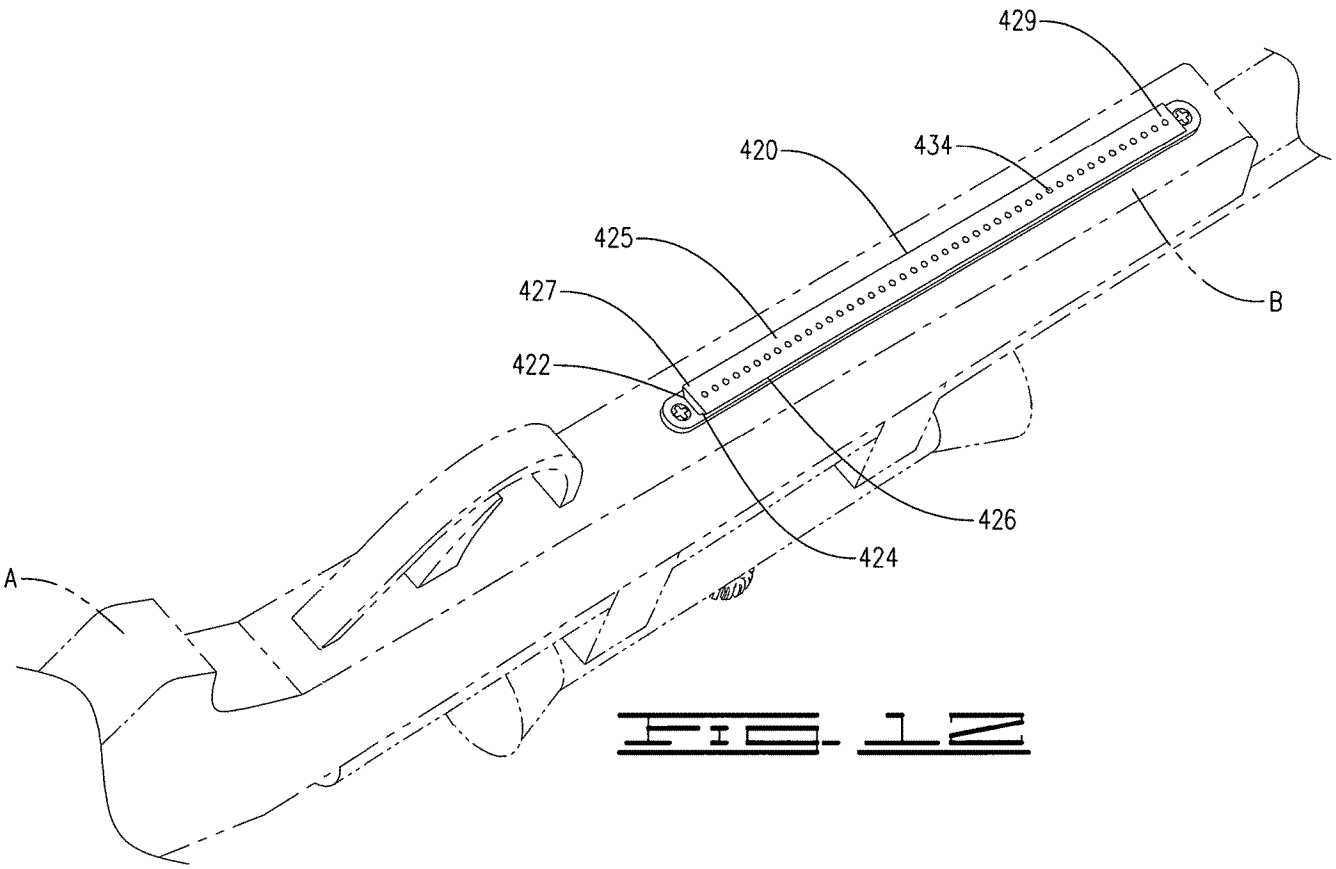
FIG. 12 is a view of an alternative linear bar rail attached to a front stock of a rifle.

It is contemplated within the scope of the barrier stabilizer assembly 10 that an alternative linear bar rail 420 defines an upper surface 422 and a lower portion 424 which extends a lower dovetail extension 426, FIG. 12, defining a flat lower surface 425. The alternative linear bar rail 420 presents a first end 427 and a second end 429, the alternative linear bar rail is affixed to, imbedded within, or incorporated into the front rifle stock, FIG. 12. Within the flat lower surface 425 of the lower dovetail extension 426 are a plurality of evenly spaced pin detents 434. Each pin detent 434 is be defined as a half spherical indentation, a hole, a partial channel or other adaptive indentation which extends into the flat lower surface 425 of the lower dovetail extension 426 in a uniform manner.

Applying the alternative linear bar rail 400 to the present rifle stabilizer assembly 10 would require modifications to the barrier block 40, bipod mounting member 60 and tripod mounting member 80. These three attachments, once again, will be generically referenced as an alternative workpiece 500 for this portion of the specification, drawings and claims. Each workpiece 500, shown in FIGS. 13A-13B, defines an upper flat portion 541 forming an inner upper dovetail slot 542 which is capable of slidably engaging the lower dovetail extension 426 of the alternative linear bar rail 420, with each workpiece 500 further extending the lower portions 546 of each respective workpiece 500, embodied above as the barrier block 40, bipod mounting member 60 or tripod mounting member 80.

The upper dovetail slot 542 of each workpiece 500 further defines a flat inner surface 543 defining at least one vertical pin bore 544 containing at least one upwardly urged lock pin 550 defining a rounded head 552 (plus a base, a shaft, a spring) to urge each lock pin 550 upward (in the same manner as the several lock pins 50, 70, 90 defined above), each workpiece 500 further defining a lock pin activation means 600 preferably located within the lower portion 546 of the respective workpiece 500. In addition to the lock pin 550 as disclosed within the drawings and referenced above, the lock pin may be embodied as a ball, a cylinder, a shaped taper, an irregular shape or any shape conforming to the pin detents 434 within the linear bar rail 420. The lock pin activation means 600 may be any of the three embodiments 100, 200, 300, as previously defined above or any other embodiment which performs the same function to lock and unlock the lock pin 550 for engagement or movement of the workpiece 500 along the lower dovetail extension 426 of the alternative linear bar rail 420.

Figure 13A:
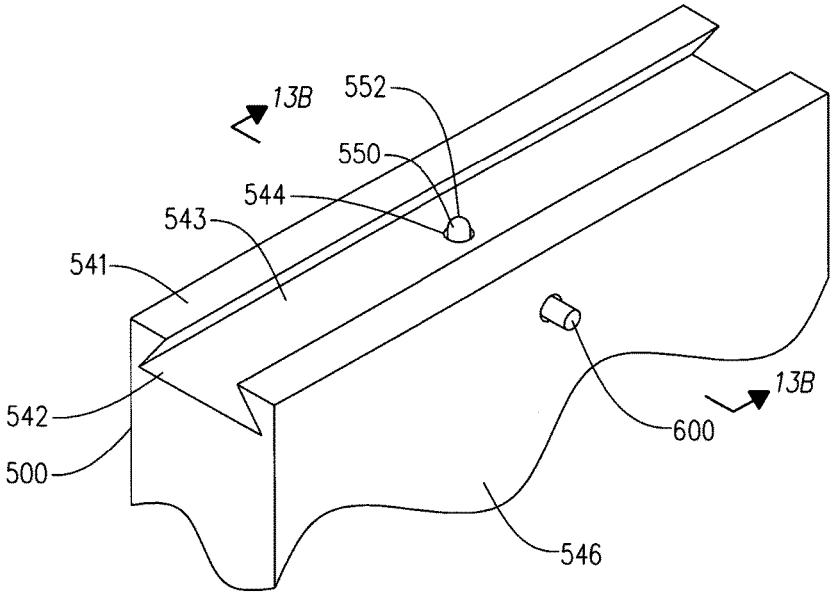
FIG. 13A is a close-up view of the alternative workpiece which integrates with the alternative linear bar rail of FIG. 12.
Figure 13B:
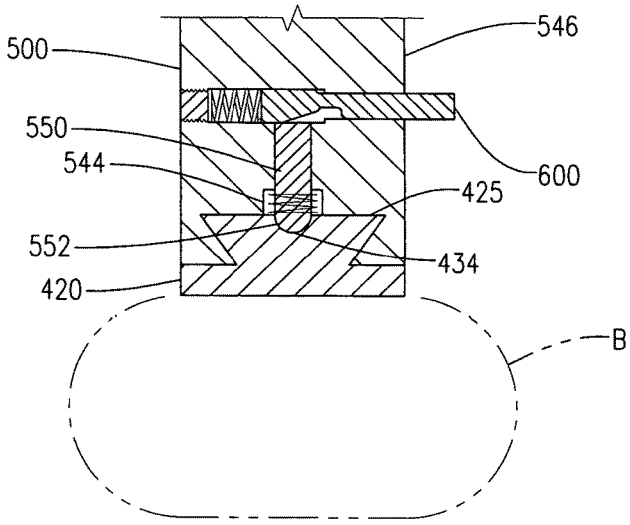
FIG. 13B is a view of an alternative workpiece integrated with the alternative linear bar rail of FIG. 12.

Each at least one lock pin 450 extends above the flat inner surface 443 of the dovetail slot 442, FIG. 13A, into a locked position, placing the cylindrical head 452 within a selected pin detent 434 as determined by the user to lock the respective workpiece 500 into a position along the lower dovetail extension of the linear bar rail 20 suited for the chosen rifle shot. Each lock pin 450 is forcibly elevated into a locked position, FIG. 13B, and prevented from downward movement until such time as the lock pin release means 100, 200, 300, is activated, allowing for the rounded head 452 of the lock pin 450 to be lowered into an unlocked position below the flat inner surface 443 and moved along the or removed from the first end 427 or second end 429.

While the adjustable rifle barrier stabilizer assembly 10 has been particularly shown and described with reference to a preferred embodiment thereof, it will be understood by those skilled in the art that changes in form and detail may be made therein without departing from the spirit and scope of the invention.

What is claimed is:

1. An adjustable rifle stabilizer assembly attaching to, imbedded within or incorporated into the a front rifle stock of a rifle, the rifle stabilizer assembly comprising:

a linear bar rail affixed to said front rifle stock defining an upper surface, a lower portion defining a linear dovetail slot presenting a first end forming a slot opening, and a second closed end, terminating within but not through said bar rail, said linear dovetail slot further defining an upper slot surface defining a plurality of evenly spaced pin detents and at least two recessed mounting bores through which respective installation screws are securely installed to secure said linear bar rail to said front rifle stock when said linear bar rail is attached to or imbedded within said front rifle stock;

a workpiece, selected from a group of attachments including one or more barrier blocks, a bipod mounting member or a tripod mounting member, each said workpiece defining a flat upper portion extending a dovetail expansion defining a flat upper surface extending above said flat upper portion adapted for insertion within said slot opening and slidable engaging said linear dovetail slot of said linear bar rail; and at least one upward urged lock pin centrally located within said upper surface of said dovetail expansion capable of being intentionally lowered below said upper surface by a lock pin release means which is situated within said workpiece to avoid interference between said linear bar rail and said workpiece during use, each at least one said lock pin defining a shaped head extending above said upper surface of said dovetail expansion into a locked position, placing said shaped head within a selected pin detent of said linear bar rail as determined by the user to lock said workpiece into a position along said linear bar rail suited for the chosen rifle shot, wherein said lock pin is forcibly elevated into a locked position and prevented from downward movement until such time as the lock pin release means is activated, allowing said shaped head of the lock pin to be lowered below said upper surface of said dovetail expansion and moved along said linear bar rail or disengaged from said slot opening.

2. The adjustable rifle stabilizer assembly of claim 1 wherein said workpiece is said at least one barrier block further comprising:

a flat upper portion extending an axially pivotal upward oval dovetail expansion slidably engaging said linear dovetail slot of said linear bar rail, said oval dovetail expansion defining an upper surface defining at least one vertical pin bore, a first barrier surface depending perpendicular from said flat upper portion, a second barrier surface depending at a reduced angle from said flat upper portion, a lower portion, a first side plate, and a second side plate, said lock pin release means extending from said first or second side plate, and said at least one lock pin respectively contained within each said at least one vertical pin bore with said lock pin release means extending each said lock pin upward into a locked position within at least one selected pin indent within said linear bar rail and said lock pin release means upon depression, releasing said at least one lock pin to be lowered below said upper surface of said dovetail extension for movement within or removal from said linear bar rail.

3. The adjustable rifle stabilizer assembly of claim 1 wherein said workpiece is the bipod mounting member comprising:

a flat upper portion extending an upward dovetail expansion slidably engaging said linear dovetail slot of said linear bar rail, said upward dovetail expansion further defining a flat upper surface containing at least one vertical pin bore, said bipod mounting member further defining a front margin, a rear margin, and a lower portion defining a bipod mounting base, wherein said lock pin release means extends from said front or rear margin, and said at least one lock pin respectively contained within each said at least one vertical pin bore with said lock pin release means extending each said lock pin upward into a locked position within at least one selected pin indent within said linear bar rail and said lock pin release means upon depression, releasing said at least one lock pin to be lowered below said upper surface of said dovetail extension for movement within or removal from said linear bar rail.

4. The adjustable rifle stabilizer assembly of claim 1 wherein said workpiece is the tripod mounting member comprising:

a flat upper portion extending an upward dovetail expansion slidably engaging said linear dovetail slot of said linear bar rail, said upward dovetail expansion further defining a flat upper surface containing at least one vertical pin bore, said tripod mounting member further defining lateral portions, and a lower portion defining a tripod mounting base, wherein said lock pin release means extends from said at least one lateral portion, and said at least one lock pin respectively contained within each said at least one vertical pin bore with said lock pin release means extending each said lock pin upward into a locked position within at least one selected pin indent within said linear bar rail and said lock pin release means upon depression, releasing said at least one lock pin to be lowered below said upper surface of said dovetail extension for movement within or removal from said linear bar rail.

5. The adjustable rifle stabilizer assembly of claim 1 comprising:

each said at least one lock pin further defines a shaped head, a base, and a shaft defining a reduced central portion and urged upward from said vertical pin bore by a first spring; and said lock pin release means further defines a transverse bore within said lower portion of said workpiece, a release pin providing a depression end, a base end, a cylindrical shaft defining a reduced bypass portion biased outward within said transverse bore by a second spring, wherein said depression end of said release pin in depressed, moving said release pin inward to aligned said reduced bypass portion into an intersection with said reduced central portion of said at least one lock pin, allowing said lock pin to be raised or lowered within said respective vertical pin bore, and wherein said release pin, when not depressed, aligns said shaft of said release pin within said reduced central portion of said lock pin, preventing downward movement of said lock pin and preventing said shaped head from being disengaged with said respective pin detent to unlock said workpiece from a locked position within said linear bar rail.

6. The adjustable rifle stabilizer assembly of claim 1 comprising:

each said at least one lock pin further defines a shaped head, a base, a shaft with each said at least one lock pin urged upward from said vertical pin bore by a first spring; and said lock pin release means further defines a transverse bore within said lower portion of said workpiece, a release pin providing a depression end, a base end, a cylindrical shaft defining a tapered shaft portion leading into a reduced diameter portion biased outward within said transverse bore by a second spring, wherein said depression end of said release pin in depressed, moving said release pin inward to aligned said reduced diameter portion below said base of said at least one lock pin, allowing said lock pin to be lowered within said respective vertical pin bore, and wherein said release pin, when not depressed, aligns said shaft of said release pin below said base of said lock pin, preventing downward movement of said lock pin and preventing said shaped head from being disengaged with said respective pin detent to unlock said workpiece from a locked position within said linear bar rail.

7. The adjustable rifle stabilizer assembly of claim 1 comprising:

each said at least one lock pin further defines a shaped head, a base, a shaft engaged within each said vertical pin bore;

said workpiece defining a lateral slot within said lower portion containing a vertically oriented outer thread shaft upon which is rotatably engaged a central thread bore of a rotating wheel extending transversely through said lateral slot, said rotating wheel defining an upper surface, each said base of each lock pin extending within said lateral slot, wherein said rotating wheel, when elevated upon said outer threaded shaft applied an upward force to said base of each said at least one lock pin, forcing said shaped head upward into a locked engagement with said respective pin detent within said linear bar rail, placing said workpiece in a stationary location upon said linear bar rail, and wherein said rotating wheel, when lowered upon said outer threaded shaft, allows for said base of each said at least one lock pin to be retracted within said vertical pin shaft of said workpiece, releasing said lock pin from each respective pin detent within said linear bar rail to unlock said workpiece from a locked position within said linear bar rail.

8. An adjustable rifle stabilizer assembly attaching to, imbedded within or incorporated into the a front rifle stock of a rifle, the rifle stabilizer assembly comprising:

a linear bar rail defining an upper surface and a lower portion extending a lower dovetail extension defining a flat lower surface, a first end and a second end, said flat lower surface presenting a plurality of evenly spaced pin detents in a uniform linear manner;

a workpiece, selected from a group of attachments including one or more barrier blocks, a bipod mounting member or a tripod mounting member, each said workpiece defining a flat upper portion forming an inner upper dovetail slot capable of slidably engaging said lower dovetail extension of said linear bar rail, each said workpiece further extending said lower 0 portion, said upper dovetail slot of each said workpiece further defining a flat inner surface including at least one vertical pin bore;

at least one upwardly urged lock pin defining a shaped head extending above said flat inner surface of said dovetail slot into a locked position, placing the shaped head within a selected pin detent as determined by the user to lock the respective workpiece into a position along said lower dovetail extension of said linear bar rail suited for the chosen rifle shot, wherein each said lock pin is forcibly elevated into a locked position and prevented from downward movement until such time as said lock pin release means is activated, allowing for said shaped head of said lock pin to be lowered into an unlocked position below said flat inner surface and moved along or removed from said first end or second end of said linear bar rail; and each said at least one lock pin further defines a shaped head, a base, and a shaft defining a reduced central portion and urged upward from said vertical pin bore by a first spring; and said lock pin release means further defines a transverse bore within said lower portion of said workpiece, a release pin providing a depression end, a base end, a cylindrical shaft defining a reduced bypass portion biased outward within said transverse bore by a second spring, wherein said depression end of said release pin in depressed, moving said release pin inward to aligned said reduced bypass portion into an intersection with said reduced central portion of said at least one lock pin, allowing said lock pin to be raised or lowered within said respective vertical pin bore, and wherein said release pin, when not depressed, aligns said shaft of said release pin within said reduced central portion of said lock pin, preventing downward movement of said lock pin and preventing said shaped head from being disengaged with said respective pin detent to unlock said workpiece from a locked position within said linear bar rail.

9. The adjustable rifle stabilizer assembly of claim 8 wherein said workpiece is said at least one barrier block further comprising:

a flat upper portion extending an axially pivotal upward linear dovetail slot slidably engaging said lower dovetail expansion of said linear bar rail, said upward dovetail slot defining a flat inner surface defining at least one vertical pin bore, and a lower surface further defining a first barrier surface depending perpendicular from said flat upper portion, a second barrier surface depending at a reduced angle from said flat upper portion, a lower portion, a first side plate, and a second side plate, said lock pin release means extending from said first or second side plate, and said at least one lock pin respectively contained within each said at least one vertical pin bore with said lock pin release means extending each said lock pin upward into a locked position within at least one selected pin indent within said flat lower surface of said lower dovetail extension of said linear bar rail and said lock pin release means upon depression, releasing said at least one lock pin to be lowered below said upper surface of said dovetail extension for movement within or removal from said linear bar rail.

10. The adjustable rifle stabilizer assembly of claim 8 wherein said workpiece is said bipod mounting member further comprising:

a flat upper portion extending an upper linear dovetail slot slidably engaging said lower dovetail extension of said linear bar rail, said upper linear dovetail slot defining a flat inner surface containing at least one vertical pin bore, said bipod mounting member further defining a front margin, a rear margin, and a lower portion defining a bipod mounting base, wherein said lock pin release means extends from said front or rear margin, and said at least one lock pin respectively contained within each said at least one vertical pin bore with said lock pin release means extending each said lock pin upward into a locked position within at least one selected pin indent within said flat lower surface of said lower dovetail extension of said linear bar rail and said lock pin release means upon depression, releasing said at least one lock pin to be lowered below said upper surface of said dovetail extension for movement within or removal from said linear bar rail.

11. The adjustable rifle stabilizer assembly of claim 8 wherein said workpiece is the tripod mounting member comprising:

a flat upper portion extending an upper linear dovetail slot slidably engaging said lower dovetail extension of said linear bar rail, said upper linear dovetail slot defining a flat inner surface containing at least one vertical pin bore, said tripod mounting member further defining lateral portions, and a lower portion defining a tripod mounting base, wherein said lock pin release means extends from said at least one lateral portion, and said at least one lock pin respectively contained within each said at least one vertical pin bore with said lock pin release means extending each said lock pin upward into a locked position within at least one selected pin indent within said linear bar rail and said lock pin release means upon depression, releasing said at least one lock pin to be lowered below said upper surface of said dovetail extension for movement within or removal from said linear bar rail.

12. The adjustable rifle stabilizer assembly of claim 8 comprising:

each said at least one lock pin further defines a shaped head, a base, a shaft with each said at least one lock pin urged upward from said vertical pin bore by a first spring; and said lock pin release means further defines a transverse bore within said lower portion of said workpiece, a release pin providing a depression end, a base end, a cylindrical shaft defining a tapered shaft portion leading into a reduced diameter portion biased outward within said transverse bore by a second spring, wherein said depression end of said release pin in depressed, moving said release pin inward to aligned said reduced diameter portion below said base of said at least one lock pin, allowing said lock pin to be lowered within said respective vertical pin bore, and wherein said release pin, when not depressed, aligns said shaft of said release pin below said base of said lock pin, preventing downward movement of said lock pin and preventing said shaped head from being disengaged with said respective pin detent to unlock said workpiece from a locked position within said linear bar rail.

* * * * *